United States Patent [19]

Kato

[11] Patent Number: 4,709,682

[45] Date of Patent: Dec. 1, 1987

[54] DEVICE FOR CONTROLLING THE PRESSURE IN THE BEARINGS OF A ROOTS BLOWER SUPERCHARGER

[75] Inventor: Kichiro Kato, Toyota, Japan

[73] Assignee: Toyota Jidosha Kabushiki Kaisha, Japan

[21] Appl. No.: 932,565

[22] Filed: Nov. 20, 1986

[30] Foreign Application Priority Data

Dec. 3, 1985 [JP] Japan ..... 60-270748

[51] Int. Cl.[4] ..... F02B 33/00

[52] U.S. Cl. ..... 123/559; 418/104

[58] Field of Search ..... 123/559; 418/104, 180

[56] References Cited

U.S. PATENT DOCUMENTS 3,178,104 4/1965 Williams et al. ..... 418/180 X
4,153,395 5/1979 O'Neill ..... 418/104 X
4,594,992 6/1986 Nakamura et al. ..... 123/559
4,657,495 4/1987 Sakamaki et al. ..... 418/104 X

FOREIGN PATENT DOCUMENTS 16232 1/1986 Japan .

*Primary Examiner*—Michael Koczo
*Attorney, Agent, or Firm*—Parkhurst & Oliff

[57] ABSTRACT

A pressure controlling device for controlling pressure acting on end faces of bearings in a Roots blower type supercharger. An end portion of a shaft having an impeller projects through an inner wall of a housing of the supercharger, and is rotatably supported by a bearing provided outside of the inner wall. An annular space is formed the bearing and the inner wall. The annular space is communicated with the atmosphere through an air passage which is connected to a control valve. The control valve closes for a predetermined period after the engine load becomes higher than a predetermined value.

7 Claims, 4 Drawing Figures

DEVICE FOR CONTROLLING THE PRESSURE IN THE BEARINGS OF A ROOTS BLOWER SUPERCHARGER

BACKGROUND OF THE INVENTION

1. Field of the Invention

The present invention relates to a pressure controlling device for controlling pressure acting on bearings provided in a Roots blower type supercharger mounted on an internal combustion engine.

2. Description of the Related Art

A Roots blower type supercharger of an internal combustion engine has two mating lobed impellers fixed on two rotary shafts, respectively, so that these impellers rotate in opposite directions to each other to carry out a pumping operation. There are usually clearances between the two impellers and between the impellers and an inner surface of a housing in which the impellers are housed, and accordingly, a part of the highly pressurized air discharged by the impellers may leak to a low pressure part in the housing through these clearances. As a result, pressure of the leaked air acts on one end face of bearings which rotatably support the rotary shafts, so that a pressure difference occurs at the end faces of each bearing. This high pressure causes grease lubricating the bearings to flow to the low pressure side of the bearing. In other words, the grease holding ability of the bearings is reduced. To prevent such a reduction of the grease holding ability caused by this pressure difference, a construction by which air pressure acting on the bearings is reduced has been proposed. That is, this construciton comprises a labyrinth formed on an inner surface of a hole through which the shaft extends, and a portion between the bearing and the labyrinth is communicated with the atmosphere, so that the above pressure difference is reduced.

In the above construction, a clearance between the labyrinth and the shaft must be rather large, to prevent contact between the labyrinth and the shaft, and an opening for connecting the portion between the bearing and the labyrinth to the atmosphere also must be large to fully reduce the air pressure acting on the bearings. With a construction having such a large clearance and opening, however, in an engine state in which the amount of intake air is considerably reduced, such as idle running, a problem occurs in that the atmospheric air is sucked into the intake passage of the engine through the labyrinth so that the amount of intake air is increased, that is, the number of revolutions of the engine is increased even though the throttle valve is closed.

To resolve this problem, in Japanese Unexamined Patent Publication No. 61-16232, the applicant has already proposed a construction in which an annular space is formed around the shaft and between the bearing and the labyrinth, and this space can be communicated with the atmosphere. The annular space is communicated with the atmosphere when supercharging occurs, and is shut off from the atmosphere when the amount of intake air is reduced to a minimum.

In the above proposed device, however, since the annular space is communicated with the atmosphere, during a sudden increase in the engine load a part of the boost pressure generated in the supercharger is released to the atmosphere through the annular space. As a result, the desired output torque of the engine is not fully realized during this sudden increase in engine load, so that the resultant acceleration of the vehicle is poor.

SUMMARY OF THE INVENTION

Therefore, an object of the present invention is to provide a pressure controlling device by which, upon a sudden increase in engine load, a part of boost pressure generated in the supercharger does not leak outside of the housing so that an output torque of the engine is sufficient to obtain a good acceleration of the vehicle.

According to the present invention, there is provided a pressure controlling device comprising a control valve connected to a passage formed in a housing of the supercharger to communicate with the atmosphere, means for sensing an increase in load of the internal combustion engine, and means for controlling the control valve to vary a flow passage area of the passage to the atmosphere according to the engine load. The controlling means closes the valve to reduce the flow passage area for a predetermined period after the sensing means senses an engine load which is higher than a predetermined value.

BRIEF DESCRIPTION OF THE DRAWINGS

The present invention may be more fully understood from the description of preferred embodiments of the invention set forth below, together with the accompanying drawings, in which.

DESCRIPTION OF THE PREFERRED EMBODIMENTS

The present invention will now be described with reference to the attached drawings.

Figure 1:
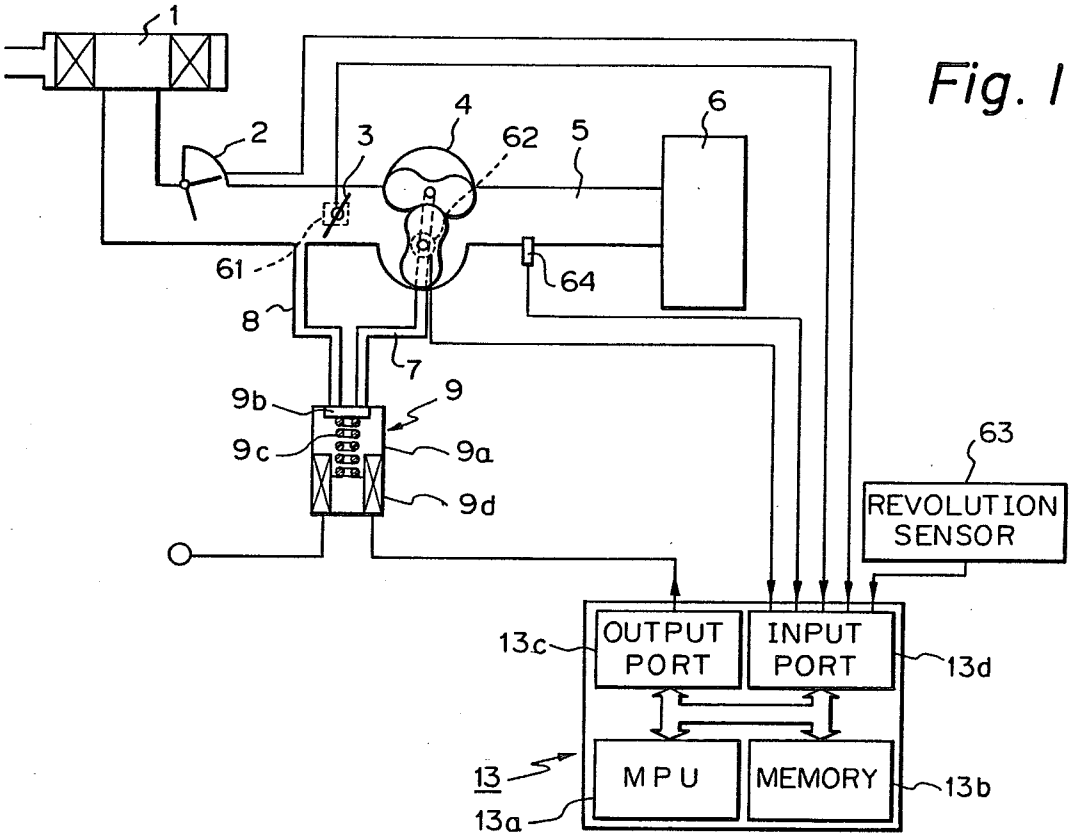
FIG. 1 is a schematic view of an internal combustion engine provided with a supercharger having a pressure controlling device.

FIG. 1 shows a general construction of an internal combustion engine having a supercharger provided with a pressure controlling device of an embodiment of the present invention. A Roots blower type supercharger 4 is provided in an intake tube 5 connected to a main body 6 of an internal combustion engine. An air filter 1 is disposed in the inlet portion of the inlet tube 5, and an air flow meter 2 is provided downstream of the air filter 1. The specific volume of intake air flowing in the intake tube 5 is measured by the air flow meter 2 and adjusted by a throttle valve 3 provided between the air flow meter 2 and the supercharger 4 and connected to an accelerating pedal (not shown). A pressure sensor 64 is provided in the intake tube 5 and between the supercharger 6 and the main body 6 to sense an intake air pressure. A first air passage 7 is connected to a housing of the supercharger 4, as described later, and a second air passage 8 is connected to an upstream portion of the throttle valve 3. A control valve 9 is connected to the first and second air passages 7 and 8 to open or close the passages 7 and 8, through control by an electronic control unit (ECU) 13 having a microcomputer.

The ECU 13 has a micro processing unit (MPU) 13*a*, a memory 13*b*, an output port 13*c*, and input port 13*d*, and a bus 13*e* which interconnects those elements. The ECU 13 opens or closes the control valve 9 according to a signal sent from an idle switch 61, a clutch sensor 62 of the supercharger 4, the air flow meter 2, a revolution sensor 63, or the pressure sensor 64. The idle switch 61 turns ON when an opening degree of the valve 9 is less than a predetermined value, to output a signal denoting an idle running of the engine. The clutch sensor 62 outputs a signal denoting a supercharging state of the supercharger 4 when a clutch of the supercharger 4 is connected. The air flow meter 2 outputs a signal corresponding to a specific volume of intake air Q. The revolution sensor 63 is provided in a distributor (not shown) to output a signal denoting the number of engine revolutions. The pressure sensor 64 outputs a signal corresponding to a pressure in the intake tube 5.

The control valve 9 has a housing **9*a* which communicates with the first and second air passages 7 and 8, and houses a valve body 9*b*, a spring 9*c*, and a solenoid 9*d*. The valve body 9*b* opens or closes the opening portions of the first and second air passages 7 and 8 to connect them or shut them off. The spring 9*c* urges the valve body 9*b* in a direction in which the valve body 9*b* will close the air passages 7 and 8. The solenoid 9*d* urges the valve body 9*b* against the spring 9*c* to open the air passages 7 and 8 when the solenoid 9*d*** is energized.

Figure 2:
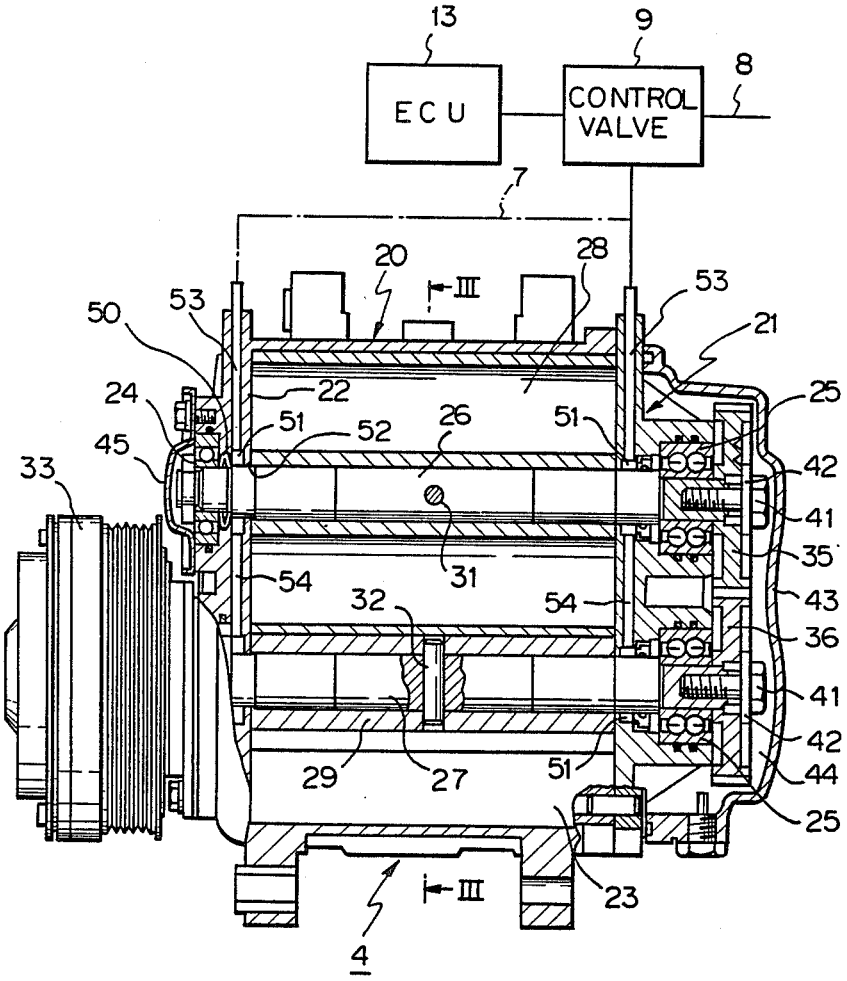
FIG. 2 is a sectional view of the supercharger having the pressure controlling device.
Figure 3:
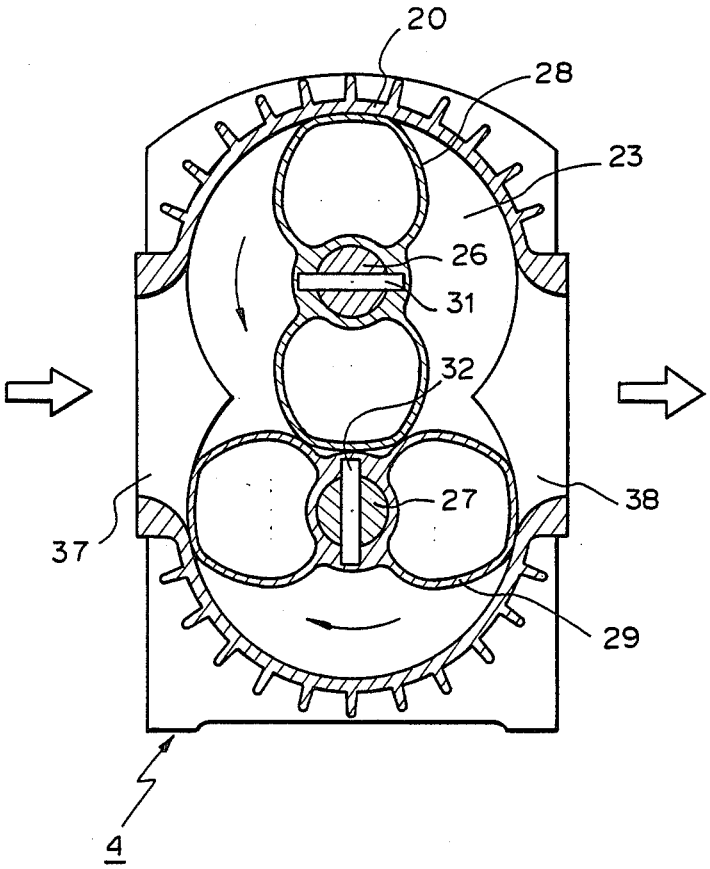
FIG. 3 is a sectional view of the supercharger taken along the line III—III of FIG. 2.

FIG. 2 shows a construction of the supercharger 4. A body 20 is formed as a cylinder having a closed end and an open end, which open end is closed by a rear plate 21; namely, a housing is formed by the body 20 and the rear plate 21. The body 20 has an inner wall 22 at the end opposite to the rear plate 21, so that a chamber 23 (FIG. 3) is defined between the inner wall 22 and the rear plate 21. Ball bearings 24 are provided in the body 20 and outside of the inner wall 22, and ball bearings 25 are provided in the outer portion of the rear plate 21. Two rotary shafts 26, 27 extend through the inner wall 22 and the rear plate 21, and are rotatably supported by the bearings 24 and 25. Lobed impellers 28 and 29 are fixed to the rotary shafts 26 and 27 by pins 31 and 32, respectively. The impellers 28 and 29 are housed in the chamber 23 and mated with each other. A pulley 33 is fixed to an end portion of the shaft 27 which projects through the inner wall 22. The pulley is connected to a crank shaft (not shown) of the engine by an endless belt, and is rotated when the engine is driven. A clutch (not shown) is housed in the pulley 33 to transmit the rotation of the pulley 33 to the shaft 27. Gears 35 and 36 are fixed on the other end portions of the shafts 26 and 27 by screws 41 and washers 42, and are meshed with each other so that rotation of the shaft 27 is transmitted to the shaft 26. Thus, the impellers 28 and 29 rotate in opposite directions to draw in air through an inlet port 37 of the housing and to compress and discharge the air through an outlet port 38 of the housing. A cover 43 is provided on an outer surface of the rear plate 21 to cover the gears 35 and 36 and the rear plate 21, and to form an oil chamber 44, and lubricating oil is reserved in the chamber 44 to lubricate the gears 35 and 36. A cap 45 is fixed on an outer surface of the inner wall 22 to cover the projecting portion of the shaft 26.

The four bearing portions supporting the rotary shafts 26 and 27 have basically the same construction, and therefore, only the bearing portion at the upper left side in FIG. 2 is described in detail. The ball bearing 24 is an oil lubricating type bearing, and therefore, an oil seal ring 50 is provided on the inner side of the inner race of the bearing 24. A hole formed in the inner wall 22 through which the shaft 27 passes has a large diameter portion near the seal ring 50 and a small diameter portion near the impeller 28. An annular space 51 is formed between the seal ring 50 and the inner wall 22. As previously known, a labyrinth portion 52 is formed on the inner surface of the small diameter portion to restrict air flow from the chamber 23 to the annular space 51, and an air passage 53 is formed in the inner wall 22 to connect the annular space 51 to the atmosphere. The air passage 53 is communicated with the air passage 7 which is connected to the control valve 9. An annular space formed in the left side bearing portion of the shaft 27 is communicated with the annular space 51 through an air passage 54 formed in the inner wall 22. The right side bearing portions have the same construction as the left side bearing portions. That is, annular spaces 51 are provided between the bearings 25 and rear plate 21, and are communicated with the air passage 7 through air passages 53 and 54 to connect to the atmosphere.

Figure 4:
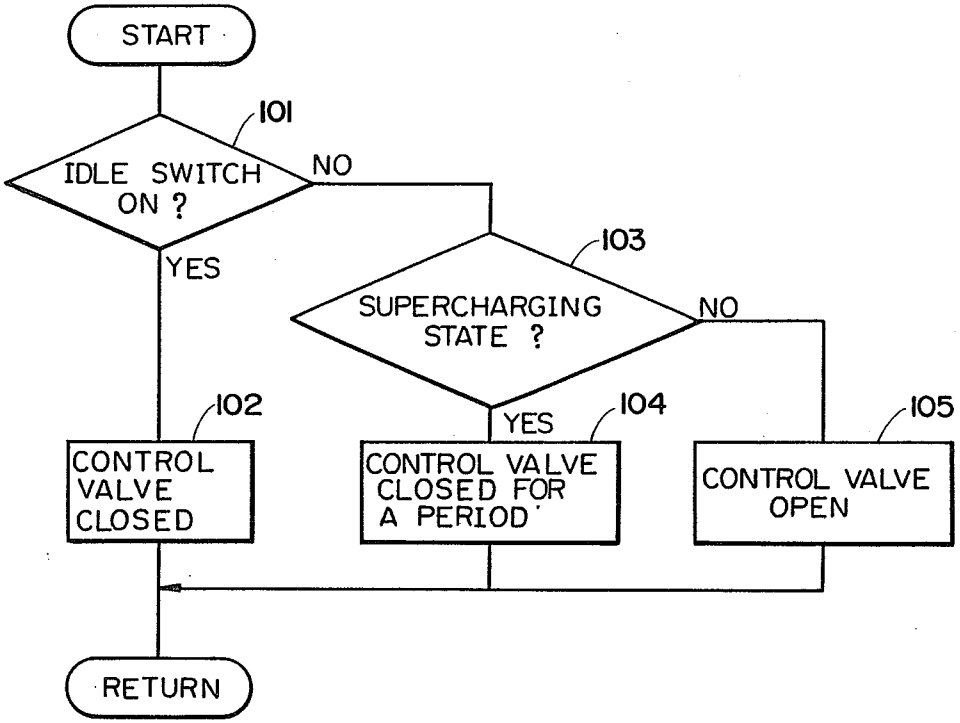
FIG. 4 is a flowchart of a control carried out by an electronic control unit.

FIG. 4 shows a flowchart of a program for controlling the control valve 9 by the ECU 13. This program is carried out by an interrupt signal output at predetermined periods. In step 101, it is judged whether or not the idle switch 62 is turned ON, that is, whether or not the engine is in an idle running state. When the engine is in the idle running state, the process proceeds to step 102 and the solenoid **9*d* is deenergized so that the control valve 9 is closed. Conversely, if the engine is not in the idle running state, the process proceeds to step 103, where it is determined whether or not the engine is running in a supercharging state, that is, whether or not the engine load has been suddenly increased. This determination of the supercharging state may be carried out by calculating the Q/N (Q; specific volume of intake air, N; the number of engine revolutions); by determining whether or not a pressure in the intake tube 5 is higher than a predetermined value; or by determining a connection state of the clutch of the supercharger 4. Thus, if the engine condition is determined to be in a supercharging state, the process proceeds to step 104 and the solenoid 9*b* is deenergized for a predetermined period, so that the control valve 9 is closed for the same period. That is, the valve body 9*b* closes the openings of the passages 7 and 8 for a predetermined period after the idle switch 61, for example, is turned OFF (the throttle valve 3 is open). A timer (not shown) is used for restricting the period for which the solenoid 9*d* is deenergized. On the other hand, in step 103, if the engine condition is determined as not being in a supercharging state, step 105 is carried out and the solenoid 9*d* is energized to open the control valve 9**.

Thus, when the engine is started and is in the idle running condition, the program of steps 101 and 102 is carried out in that order, to keep the control valve 9 closed. Conversely, if the engine is in a normal running condition, the program of steps 101, 103, and 105 is carried in that order, to keep the control valve 9 open. If the engine is in the supercharging condition, so that the vehicle is suddenly accelerated, the program of steps 101, 103, and 104 is carried out in that order, to close the control valve 9 for a predetermined period and then again open it. Therefore, whenever the supercharging state occurs, the control valve 9 closes for a predetermined period and then again opens.

The end surface of the bearing 24 is subjected to an intake air pressure in the chamber 23 through the labyrinth 52 and the annular space 51. In a normal running condition of the engine, an electric current is applied to the control valve 9, and the valve body **9*d* is drawn against the spring 9c by an electromagnetic force generated in the solenoid 9d, to open the passages 7 and 8. Therefore, the passages 7 and 8 are communicated with each other, and accordingly the annular space 51 is communicated with the upstream portion of the throttle valve 3 where the pressure is approximately the atmospheric pressure, because that portion is communicated with the atmosphere through the air filter 1. This means that the air in the annular space 51 is bled to the upstream portion. That is, the pressure in the annular space 51 is reduced, and thus the pressure difference between both end surfaces of the bearing 24 becomes a very small value. Therefore, grease confined in the bearing 24 is prevented from flowing toward the outside of the bearing 24**.

On the other hand, in an idle running condition, the ECU 13 cuts the electric current to the control valve 9, so that the valve body 9b of the control valve 9 closes the openings of the passages 7 and 8, by force of the spring 9c, and the ECU 13 cuts out the clutch of the supercharger 4. As a result, the end face of the bearing 24 is subjected to a negative pressure from the downstream portion of the intake tube 5 through the chamber 23 and the seal ring 50. But, since the impellers 28 and 29 are not rotating, the lubricating oil in the bearing does not substantially leak to the inside of the bearing 24. That is, the function of the seal ring 50 is not affected. Further, since the control valve 9 is closed, the atmospheric air is barred by the valve 9 from entering the annular space 51 through the air passage 7. That is, the atmospheric air is not led to the downstream portion of the supercharger 4 in the intake tube 5 through the labyrinth portion 52 and the chamber 23, so that the specific volume of intake air is not increased to prevent an increase in the engine load.

When the engine load is higher than a predetermined value, so that the supercharger 4 is driven, the control valve 9 is closed for a predetermined period. Therefore, highly pressurized air generated in the chamber 23 is not released to the atmosphere through the annular chamber 51 and the air passage 53, and any reduction in the boost pressure is prevented. As a result, a required boost pressure of the intake air is supplied into a combustion chamber of the engine, so that the acceleration performance of the vehicle is improved. Such a operation in which the control valve 9 is closed after the start of a supercharging operation is restricted to a predetermined period, and therefore, the temperature of the grease in the bearing does not become high during that period, so that the viscosity of the grease is not reduced, and thus the grease does not flow out from the bearing.

Note that, although the above embodiment has a construction in which the control valve 9 is closed when the supercharger 4 starts to operate, the control valve 9 may not close fully, but the control valve 9 may be closed to a predetermined opening to reduce the flow passage area to be lower than a predetermined value. Further, the control valve 9 need not be an electromagnetic valve, as in the above embodiment, but may be a diaphragm device which has a diaphragm moved by a negative pressure to open and close a valve.

As described above, according to the present invention, during normal running of the engine, even if an intake pressure acts on a bearing, a part of the pressurized air is bled away so that the pressure difference acting on both end faces of the bearing is reduced, and therefore, grease lubricating the bearing is fully retained by an oil seal ring provided on the end face of the bearing. In an idle running condition, an increase of a specific volume of intake air and the engine load are prevented. Further, upon a sudden increase in the engine load, a boost pressure is accordingly increased without harming the durability of the supercharger, so that the acceleration performance of the vehicle is improved.

Although embodiments of the present invention have been described herein with reference to the attached drawings, many modifications and changes may be made by those skilled in this art without departing from the scope of the invention.

What is claimed:

1. A pressure controlling device for controlling pressure acting on bearings provided in a Roots blower type supercharger mounted on an internal combustion engine, said supercharger having a housing formed with an inner wall to define a chamber therein, said bearings being provided in said housing and outside of said inner wall, two rotary shafts extending through said inner wall and provided with impellers which are housed in said chamber and mated with each other, said shafts being rotatably supported by said bearings, an annular sealing member being provided on an end face of at least one of said bearings to form an annular space between said at least one of said bearings and said inner wall, said annular space being communicated with the atmosphere through an air passage formed in said housing, said pressure controlling device comprising;

a control valve connected to said air passage, means for sensing an increase in load of said internal combustion engine, and means for controlling said control valve to vary a flow passage area of said air passage according to said engine load, said controlling means closing said valve to reduce said flow passage area for a predetermined period after said sensing means senses an engine load which is higher than a predetermined value.

2. A pressure controlling device according to claim 1, wherein said air passage is connected to an upstream portion of an intake passage in which said supercharger is provided, and is communicated with the atmosphere through said upstream portion.

3. A pressure controlling device according to claim 1, wherein said control valve comprises a valve body which opens or closes said air passage, a spring urging said valve body in a direction in which said valve body closes said air passage, and a solenoid urging said valve body in a direction in which said valve body opens said air passage when said solenoid is energized.

4. A pressure controlling device according to claim 3, wherein said valve body opens or closes said air passage of said housing according to said engine load.

5. A pressure controlling device according to claim 1, wherein said sensing means senses a specific volume of intake air and the number of revolutions of said engine.

6. A pressure controlling device according to claim 1, wherein said sensing means senses a pressure in a downstream portion of an intake passage in which said supercharger is provided.

7. A pressure controlling device according to claim 1, wherein said sensing means senses a connecting state of a clutch of said supercharger.

* * * * *